US006892456B2

(12) United States Patent
Yu Chen

(10) Patent No.: US 6,892,456 B2
(45) Date of Patent: May 17, 2005

(54) CARDBOARD BOX UNPACKING DEVICE

(76) Inventor: Hsiu-Man Yu Chen, No. 27, Sec. 1, Ta Fu Road, Tan Tzu Hsiang, Taichung (TW), 427

( * ) Notice: Subject to any disclaimer, the term of this patent is extended or adjusted under 35 U.S.C. 154(b) by 0 days.

(21) Appl. No.: 10/359,645

(22) Filed: Feb. 7, 2003

(65) Prior Publication Data

US 2004/0154167 A1 Aug. 12, 2004

(51) Int. Cl.[7] ..... B26B 11/00
(52) U.S. Cl. ..... 30/2; 30/125; 7/158
(58) Field of Search ..... 30/125, 136, 142, 30/143, 123, 162, 2; 7/158, 160

(56) References Cited

U.S. PATENT DOCUMENTS 3,299,449 A * 1/1967 Olney ..... 7/132
4,028,758 A * 6/1977 O'Connor ..... 7/158
4,517,741 A * 5/1985 Castelluzzo ..... 30/162
4,670,926 A * 6/1987 Bruno ..... 7/160
4,783,867 A * 11/1988 Tsao ..... 7/160
D328,229 S * 7/1992 Gmoch ..... D8/99
5,511,262 A * 4/1996 Horng ..... 7/160
5,513,405 A * 5/1996 Bradbury et al. ..... 7/158
6,163,910 A * 12/2000 Cheldin ..... 7/160
D438,440 S * 3/2001 Cheldin ..... D8/48
6,330,749 B1 * 12/2001 Khachatoorian et al. ..... 30/162
6,374,497 B1 * 4/2002 Sun ..... 30/162

* cited by examiner

*Primary Examiner*—Stephen Choi
(74) *Attorney, Agent, or Firm*—Troxell Law Office, PLLC

(57) ABSTRACT

A cardboard box unpacking device has a blade positioned in a slanting blade groove fo a main body and a covering body for cutting off plastic packaging strap tensioned on a cardboard box, a staple removing device provided at the upper rear side of the main body for removing staples from the cardboard box and a telescopic blade device disposed at the lower portion of the covering body for culling off adhesive tape adhered to the cardboard box.

4 Claims, 3 Drawing Sheets

CARDBOARD BOX UNPACKING DEVICE

BACKGROUND OF THE INVENTION

This invention relates to a cardboard box unpacking device, particularly to one provided with a blade for cutting off plastic packaging straps of a cardboard box, a staple removing device for removing staples from the cardboard box and a telescopic blade device for cutting off adhesive tape stuck on the cardboard box.

As commonly known, a cardboard box is used for packing articles for facilitating transporting, and after packing, the cardboard box has to be sealed by adhesive tape adhered to its seams or edges in order to protect the articles inside, but if a cardboard box is packed with heavy articles or is to be transported distantly, it has to be strapped by tough plastic packaging straps to ensure its safety. To unpack a cardboard box, a receiver usually employs a technical knife or a pair of scissors to cut off the plastic packaging straps and the adhesive tape on the cardboard box; nevertheless, such tools are not necessarily applicable to cutting off tough plastic packaging straps tensioned on the cardboard box.

For the present, a cardboard box unpacking device provided with a slanting blade at the upper end of its handle is specially used for cutting off tough plastic packaging straps tensioned on a cardboard box, but it cannot cut off adhesive tape stuck to the seams and edges of the cardboard box, nor can it remove staples thereon.

SUMMARY OF THE INVENTION

The objective of the invention is to offer a cardboard box unpacking device provided with a blade in a slanting blade groove for cutting off plastic packaging straps tensioned on a cardboard box, a staple-removing device at the upper rear side of a main body for removing staples from the cardboard box and a telescopic blade device at the lower portion of a covering body for cutting off adhesive tape stuck to the seams and edges of the cardboard box, able to remove all the sealing members of a cardboard box with one round.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
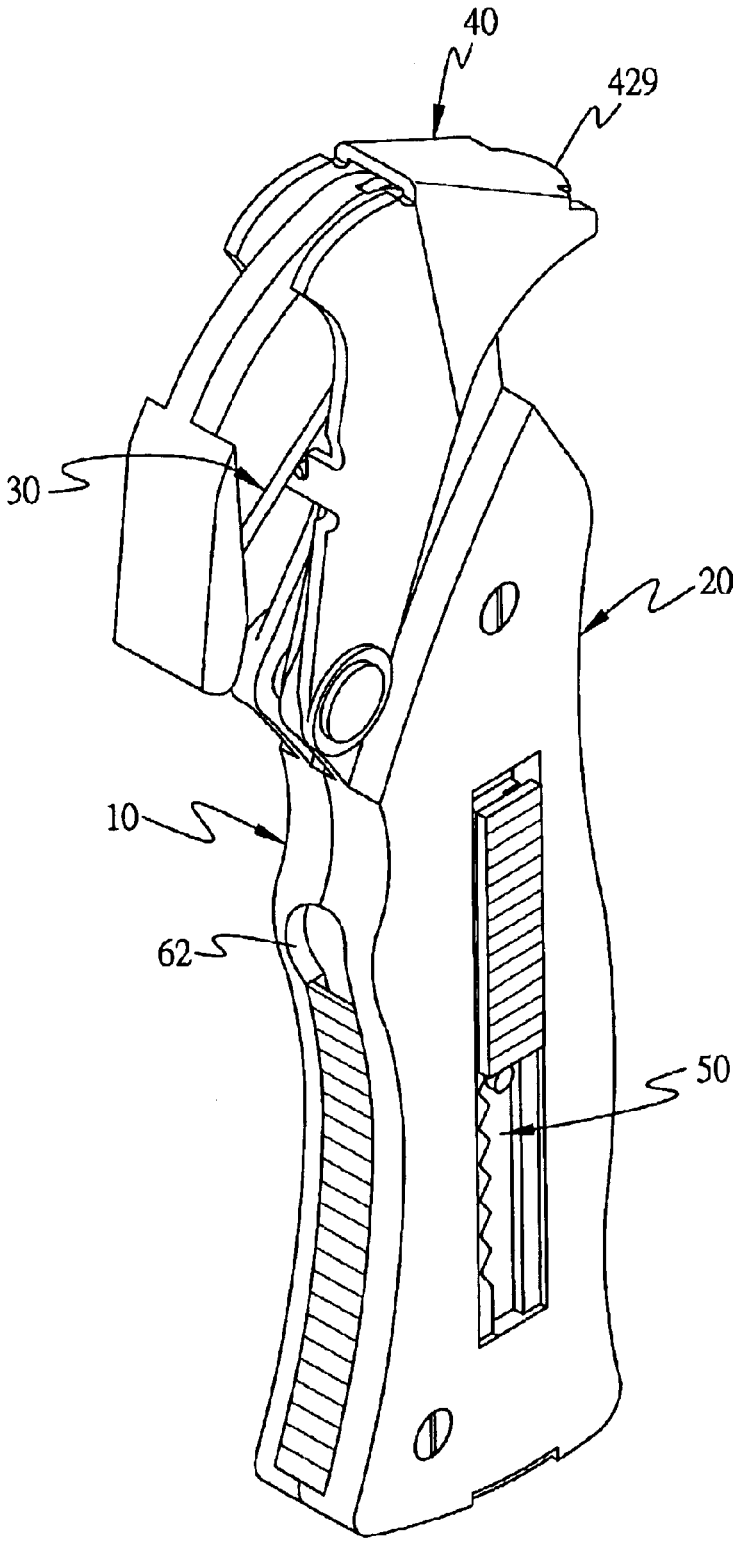
FIG. 1 is a perspective view of a cardboard box-unpacking device in the present invention.
Figure 2:
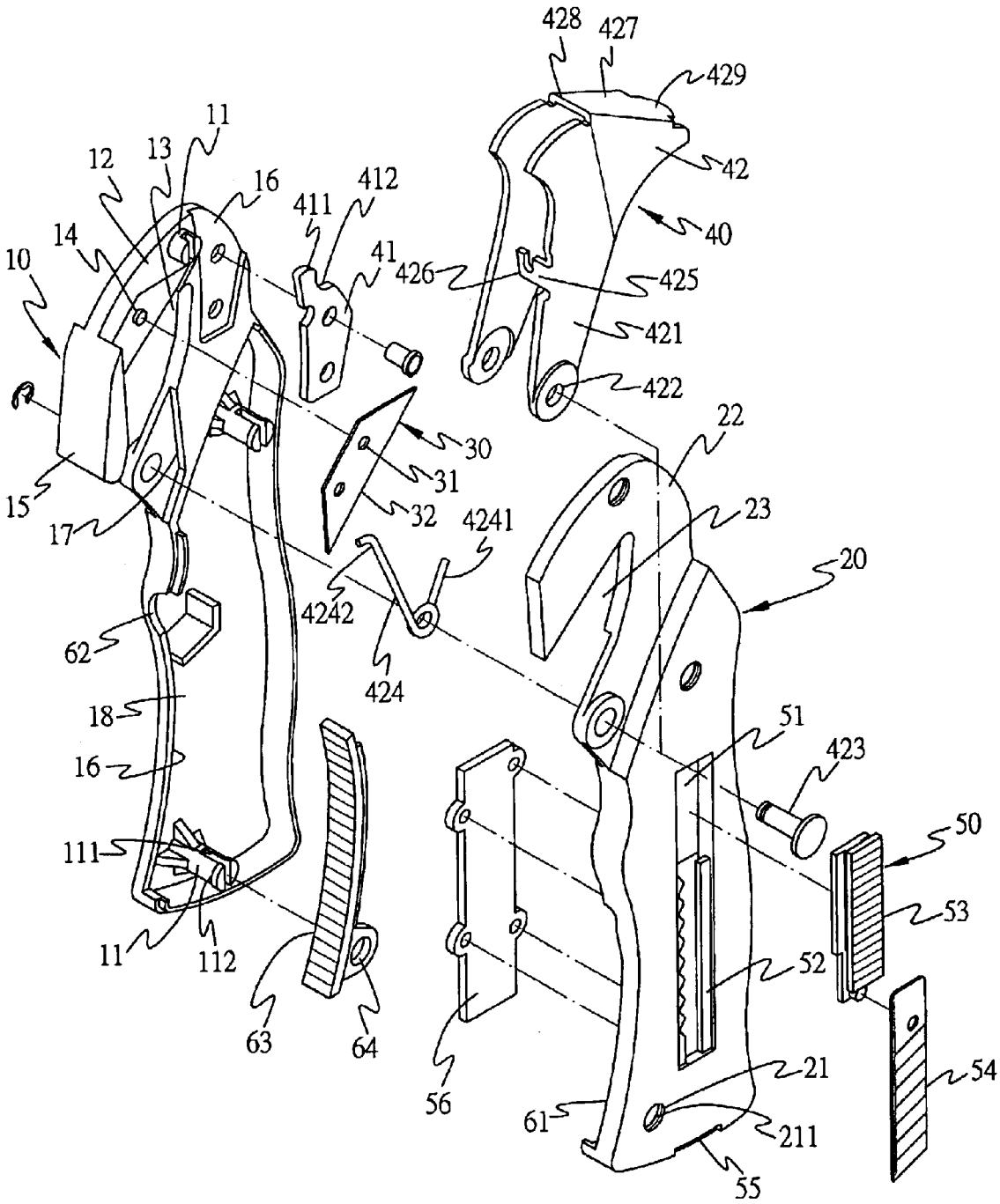
FIG. 2 is an exploded perspective view of the cardboard box-unpacking device in the present invention.
Figure 3:
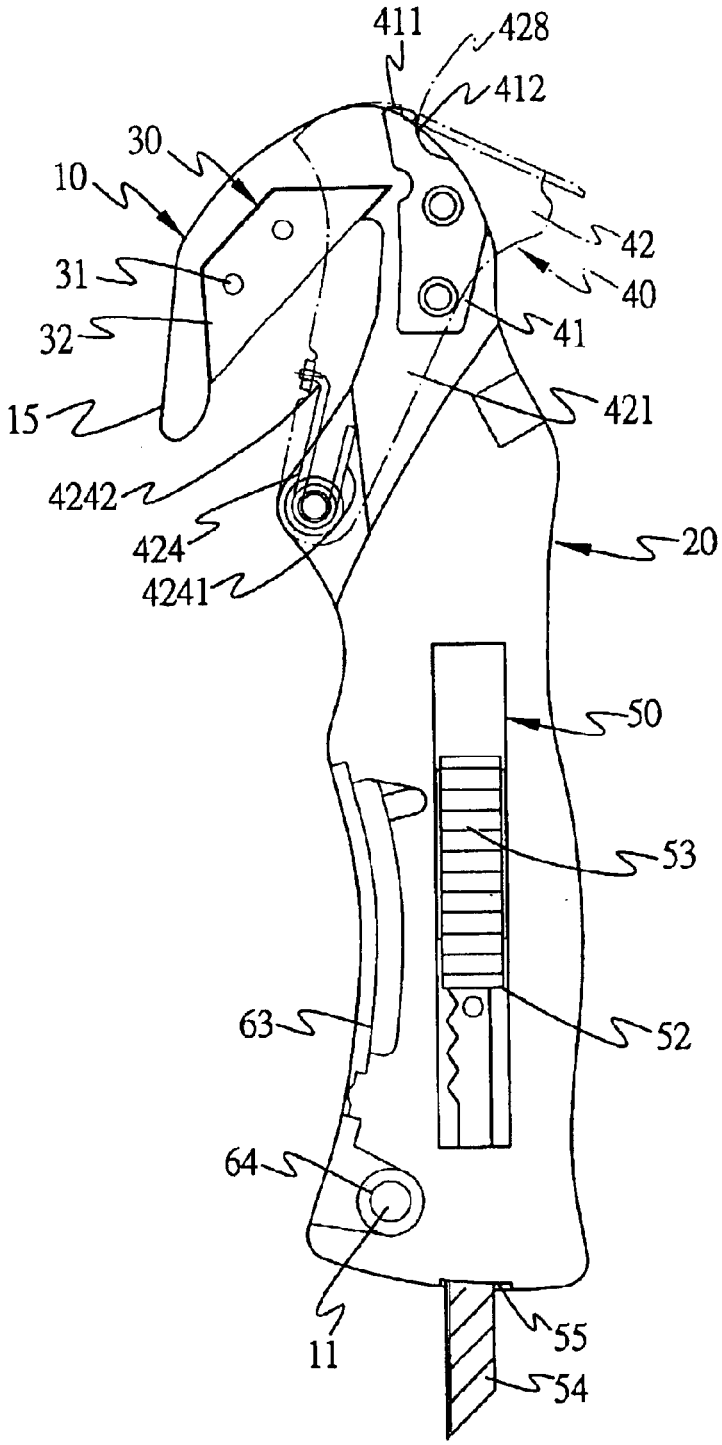
FIG. 3 is a partial side cross-sectional view of the cardboard box-unpacking device in the present invention.

A preferred embodiment of a cardboard box unpacking device in the present invention, as shown in FIGS. 1 and 2, includes a main body 10, a covering body 20, a blade 30, a staple removing device 40 and a telescopic blade device 50 as main components combined together.

The cardboard box-unpacking device is formed by correspondingly combining together the main body 10 with the covering body 20, which are made of plastic. The main body 10 has a plurality of combining studs 11 respectively fixed at the upper and the lower inner side. Each combining stud 11 is bored in the center with a slot 111 having opposite walls respectively formed with a projecting edge 112 at the upper end. The covering body 20 has a plurality of engage holes 21 respectively bored at the upper and the lower side, with each engage hole 21 having an engage edge 211 at the bottom. The main body 10 is combined together with the covering body 20 by inserting respectively the combining studs 11 through the engage holes 21 and letting the projecting edge 112 firmly stuck with the engage edge 211.

The main body 10 and the covering body 20 are respectively formed integral with a symmetrical top plate 12, 22 and respectively have a slanting blade groove 13, 23 formed under the top plate 12, 22. The top plate 12 of the main body 10 is fixed with two studs 14 to be respectively fitted in two round holes 31 of the blade 30, letting the blade edge 32 of the blade 30 exposed at a preset location in the blade groove 13, 23 for cutting off the plastic packaging straps tensioned on a cardboard box. The top plate 12 of the main body 10 has a comparatively wide protective plate 15 positioned in front of the blade groove 13 to protect a user's fingers from being cut and hurt by the blade 30.

The staple removing device 40 positioned at the upper rear side of the main body 10 has a metal reinforcing member 41 fixedly riveted in the recessed groove 16 at the upper rear side of the main body 10. The metal reinforcing member 41 is formed with a projecting-up plate 411 extending out of the main body 10 and having a stop notch 412 at the rear side. A metallic cover 42 has two parallel side plates 421 respectively provided at the lower end with a shaft hole 422 inserted therethrough with a support shaft 423 to be pivotally combined with the main body 10 and the covering body 20 at a position under the blade groove 13, 23. A spring 425 is fitted on the intermediate portion of the support shaft 423, having its fixing end 4241 firmly stuck in the engage groove 17 of the main body 10 and the other end formed with a hook 4242 to hook at the clasping notch 426 of a clasping plate 425 in front of the metal reinforcing member 41. A top cover 427 is mounted on the topside of the two side plates 421 of the metallic cover 42, having its front edge 428 forced by the spring 424 to resist against the stop notch 412 of the metal reinforcing member 41 for stabilizing and supporting the metallic cover 42 to enable the staple removing member 429 at the rear side of the top cover 427 remove staples from a cardboard box with ease.

The telescopic blade device 50 provided with a technical blade is positioned at the lower portion of the covering body 20. The covering body 20 has its sidewall bored with a vertical straight groove 51 for a slide base to be fixed therein. A push button 53 is movably fitted on the slide base 52 to slide thereon to push a blade 54 to extend out of a mouth 55 at the bottom of the covering body 20 for cutting off adhesive tape adhered to the seams and the edges of a cardboard box. Besides, an inner cover 56 is secured on the inner side of the vertical straight groove 51 by screwing or riveting or gluing to fix the slide base 52.

In addition, when the main body 10 and the covering body 20 are combined together, an elongate opening 61 with a pulling hole 62 at the upper end is formed between the lower front jointed portion of the main body 10 and the covering body 20. An elongate covering plate 63 is provided to close up the elongate opening 61, having a lower shaft hole 64 pivotally fitted with the combining stud 11 at the lower end of the main body 10 and is movably positioned in the fitting groove 61, letting the elongate covering plate 63 able to be pulled downward and opened, or pushed upward to close up the elongate opening 61. Further, the main body 10 has a chamber 18 formed at the inner side of the covering plate 63 for storing reserved blades which can be easily taken out for use only by extending fingers into the pulling hole 62 and pulling open the covering plate 63.

As can be noted from the above description, this invention has the following advantages.

1. The blade 30 positioned in the blade groove 13, 23 can be used for cutting off plastic packaging straps tensioned on a cardboard box, the staple removing device 40 provided at the upper rear side of the main body 10 can be used for removing staples from the cardboard box and the telescopic blade device 50 disposed at the lower portion of the covering body 20 can be used for cutting off adhesive tape adhered to the seams and the edges of the cardboard box, able to remove all sealing members from a cardboard box at the same time.

2. The top plates 12, 22 and the protective plate 15 positioned on the topside of the main body 10 and the covering body 20 are respectively formed integral with plastic, lowering cost and able to be produced quickly, while the staple removing device 40 has its metallic cover 42 stabilized and supported by a metal reinforcing member 41 secured in the main body 10, strengthening its whole structure.

3. The top plate 12 of the main body 10 is formed integral with the comparatively wide protective plate 15 in front of the blade groove 13 to avoid the blade 30 being damaged and protect a user 's fingers from cut and hurt by the blades 30.

4. The telescopic blade device 50 is fixedly provided with the inner cover 56 at the inner side of the vertical straight groove 51 for fixing the slide base 52 and helping to form the chamber 18 for storing reserved blades therein.

While the preferred embodiment of the invention has been described above, it will be recognized and understood that various modifications may be made therein and the appended claims are intended to cover all such modifications that may fall within the spirit and scope of the invention.

I claim:

1. An unpacking device comprising:

a) a housing including a main body and a covering body;

b) the main body having:

i) a main top plate; and ii) a main blade groove;

c) the covering body connected to the main body and having:

i) a covering top plate aligning with the main top plate; and ii) a covering blade groove aligning with the main blade groove;

d) a stationary blade removably located between the main blade groove and the covering blade groove;

e) a staple removing device pivotally connected to the housing and having:

i) a metallic cover; and ii) a staple removing member located on the metallic cover; and f) a retractable blade device located on the housing and having:

i) a retractable blade; and ii) a push button connected to and controlling the retractable blade, the retractable blade being movable between a retracted position within the housing and an extended position protruding from the housing, wherein the housing includes a recessed groove located between the main body and the covering body, and the staple removing device includes a metal reinforcing member located in the recessed groove.

2. The unpacking device according to claim 1, further comprising a protective plate located on the main body in front of the main blade groove.

3. The unpacking device according to claim 1, wherein the metal reinforcing member includes a projecting-up plate extending outwardly from the housing and a stop notch located adjacent to the projecting-up plate, the metallic cover including a front edge engaging the stop notch.

4. The unpacking device according to claim 1, wherein the housing includes an elongated opening communicating with a hollow interior of the housing and a cover plate connected to the housing and movable between open and closed positions.

* * * * *